US009503827B2

(12) United States Patent
Hu et al.

(10) Patent No.: US 9,503,827 B2
(45) Date of Patent: Nov. 22, 2016

(54) EARPHONE TESTING DEVICE

(71) Applicant: Goertek Inc., Weifang, ShanDong Province (CN)

(72) Inventors: Zongbao Hu, Weifang (CN); Wentuan Zheng, Weifang (CN); Baohui Song, Weifang (CN); Yongjun Liu, Weifang (CN); Yanpeng Zhao, Weifang (CN)

(73) Assignee: GOERTEK, INC., Weifang, ShanDong Province (CN)

( * ) Notice: Subject to any disclaimer, the term of this patent is extended or adjusted under 35 U.S.C. 154(b) by 60 days.

(21) Appl. No.: 14/432,412

(22) PCT Filed: Aug. 21, 2013

(86) PCT No.: PCT/CN2013/081985
§ 371 (c)(1),
(2) Date: Mar. 30, 2015

(87) PCT Pub. No.: WO2014/056355
PCT Pub. Date: Apr. 17, 2014

(65) Prior Publication Data

US 2015/0264501 A1 Sep. 17, 2015

(30) Foreign Application Priority Data

Oct. 9, 2012 (CN) ..... 2012 1 0381149

(51) Int. Cl.
*H04R 29/00* (2006.01)
*H04R 1/10* (2006.01)

(52) U.S. Cl.
CPC ..... *H04R 29/00* (2013.01); *H04R 29/001* (2013.01); *H04R 1/1091* (2013.01)

(58) Field of Classification Search
CPC ..... H04R 29/00; H04R 29/001; H04S 7/302; H04S 7/303; H04S 7/304
See application file for complete search history.

(56) References Cited

U.S. PATENT DOCUMENTS 4,038,500 A 7/1977 Frye
8,977,376 B1 * 3/2015 Lin ..... H04R 29/00 381/326
2009/0122996 A1 5/2009 Klein et al.

FOREIGN PATENT DOCUMENTS

CN 201967131 9/2011
CN 201995130 9/2011

(Continued)

OTHER PUBLICATIONS

CN 201210381149.X, The First Office Action, dated May 26, 2014, 8 pages, and English Translation, 8 pages.

(Continued)

*Primary Examiner* — Duc Nguyen
*Assistant Examiner* — Kile Blair
(74) *Attorney, Agent, or Firm* — Boyle Fredrickson, S.C.

(57) ABSTRACT

The present invention discloses an earphone testing device. An earphone testing device provided by the embodiments of the present invention comprises an fixation base, a standard microphone attached to the fixation base, and a fixation scaffold for attaching and fixing the fixation base and the standard microphone; the fixation base is supported and fixed on the fixation scaffold by several supporting elements; a sealer is located on the position on the fixation base in contact with the outer shell of an earphone, the sealer forms an earphone storage portion for placing the earphone; a sealer is located on the position on the fixation base in contact with the outer shell of the standard microphone, the sealer forms a microphone attachment portion for attaching to the standard microphone; the earphone placed in the earphone storage portion and the standard microphone attached onto the microphone attachment portion are communicated with each other in the fixation base. The present invention provides a stable and highly precise testing solution of earphone, which can guarantee the precision and stability of earphone testing.

8 Claims, 7 Drawing Sheets

(56) References Cited

FOREIGN PATENT DOCUMENTS

| | | |
|---|---|---|
| CN | 202957980 | 5/2013 |
| CN | 102572671 | 6/2014 |

OTHER PUBLICATIONS

CN 201210381149.X, Notice of Decision of Granting Patent For Invention, dated Aug. 22, 2014, 1 page, and English Translation, 2 pages.

* cited by examiner

EARPHONE TESTING DEVICE

TECHNICAL FIELD

The present invention relates to the technical field of earphone development, particularly relates to an earphone testing device.

BACKGROUND ART

In recent years, with the progress of society, the development of science and technology and the enhancement of people consumption concept, many consumers have higher and higher requirements for high acoustic quality and high performance of earphone, which also means that the testing solution of earphone performance needs high precision and stability, so as to ensure that high-performance earphone products can be provided to the users.

Currently, how to provide a stable and highly precise testing solution of earphone is a huge test and challenge to the quality and production of earphone industry.

SUMMARY OF THE INVENTION

The present invention provides an earphone testing device, to solve the problem of lacking a stable and highly precise testing solution of earphone in the prior art.

To achieve the aforesaid purpose, an embodiment of the present invention carry on the following technical solutions:

The embodiment of the present invention provides an earphone testing device, comprising a fixation base, a standard microphone attached to the fixation base, and a fixation scaffold for attaching and fixing the fixation base and the standard microphone; the fixation base is supported and fixed on the fixation scaffold by several supporting elements;

a sealer is located on the position on the fixation base in contact with the outer shell of an earphone, the sealer forms an earphone-storage portion for placing the earphone;

a sealer is located on the position on the fixation base in contact with the outer shell of the standard microphone, the sealer forms a microphone attachment portion for attaching to the standard microphone;

the earphone placed in the earphone storage portion and the standard microphone attached onto the microphone attachment portion are communicated with each other in the fixation base.

The beneficial effects of the embodiment of the present invention, are in that:

The earphone testing device according to the embodiment of the present invention, by the earphone storage portion in contact with the outer shell of the earphone and the microphone attachment portion in contact with the outer shell of the standard microphone formed by the sealer, is able to prevent sound leaking, guarantee the tightness of the earphone testing device, thus improve the precision of testing result; furthermore, the present solution guarantees the balance of the fixation base through the supporting elements and the fixation scaffold, to improve the stability of the testing result of earphone.

BRIEF DESCRIPTION OF DRAWINGS

The attached drawings described hereinbelow are only some Examples of the present invention, and to the skilled person in the art, other drawings can be obtained according to these attached drawings, without requiring any creative work.

DETAILED DESCRIPTION OF THE INVENTION

To make the purpose, technical solution and advantages of the present invention clearer, the embodiment of the present invention will be further described in details with reference to the attached drawings hereinbelow.

The earphone testing device according to the embodiment of the present invention comprises a fixation base, a standard microphone attached to the fixation base, and a fixation scaffold for attaching and fixing the fixation base and the standard microphone; the fixation base is supported and fixed on the fixation scaffold by several supporting elements;

a sealer is located on the position on the fixation base in contact with the outer shell of an earphone, the sealer forms an earphone storage portion for placing the earphone;

a sealer is located on the position on the fixation base in contact with the outer shell of standard microphone, the sealer forms a microphone attachment portion for attaching to the standard microphone;

the earphone placed in the earphone storage portion and the standard microphone attached onto the microphone attachment portion are communicated with each other in the fixation base.

Furthermore, a pass-through portion is provided in the fixation base and passes through the fixation base; the earphone storage portion is located on the fixation base and in the pass-through portion, the microphone attachment portion is located on the fixation base and in the pass-through portion, and the earphone placed in the earphone storage portion is communicated with the standard microphone attached onto the microphone attachment portion through the pass-through portion in the fixation base.

The pass-through portion can be formed by removing material in the fixation base. The sealer may be elastomeric structure. The earphone storage portion is formed above the fixation base but is not restricted thereby, and the microphone attachment portion is formed below the fixation base but is not restricted thereby.

Thus it is seen that, the earphone testing device according to the embodiment of the present invention, by the earphone storage portion in contact with the outer shell of earphone and the microphone attachment portion in contact with the outer shell of the standard microphone formed by the sealer, is able to prevent sound leaking, guarantee the tightness of the earphone testing device, thus improve the precision of testing result; furthermore, the present solution guarantees the balance of fixation base through supporting elements and the fixation scaffold, to improve the stability of the testing result of earphone.

Figure 1:
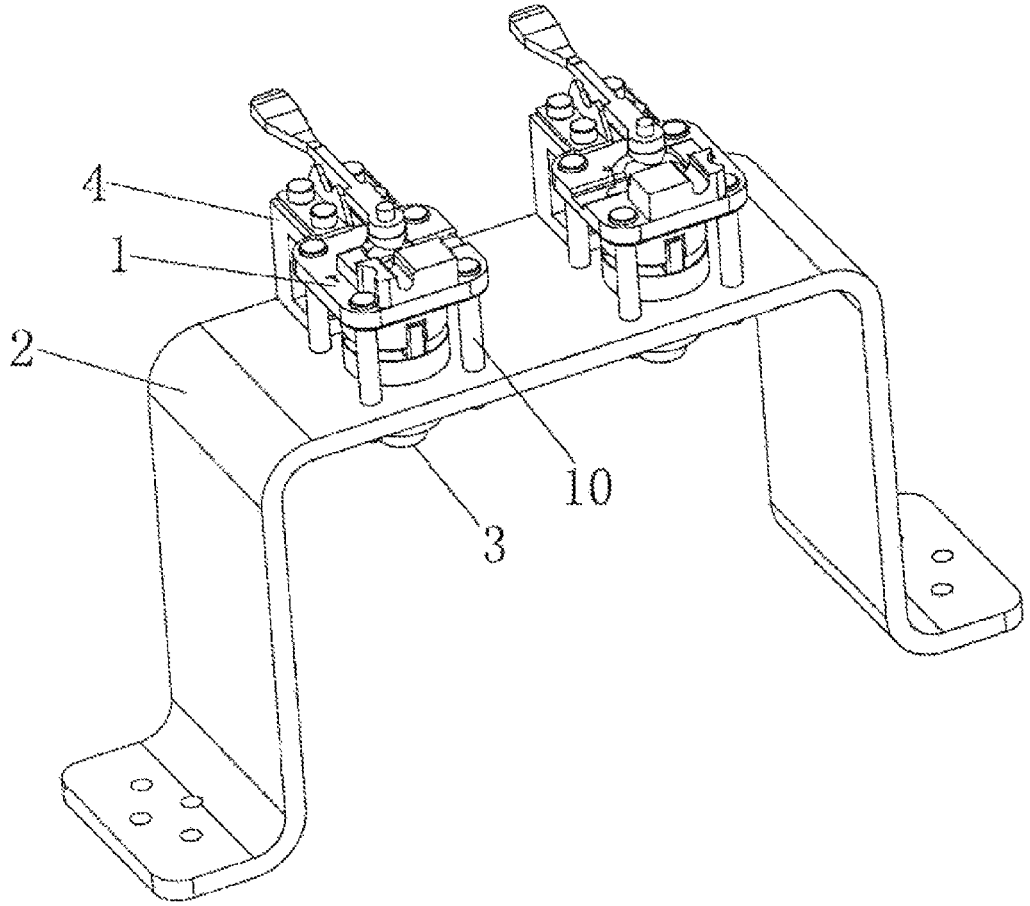
FIG. 1 is a schematic structural diagram of an earphone testing device according to an embodiment of the present invention.

The earphone testing device according to the embodiment of the present invention will be described with reference to FIG. 1 hereinbelow. FIG. 1 shows the entire structure of the earphone testing device after assembly. Wherein, the earphone testing device comprises fixation base 1 and a fixation scaffold 2, the fixation base 1 in this embodiment comprise the fixation base of left earphone and the fixation base of right earphone, and the fixation base of left earphone and the fixation base of right earphone are symmetry in structure.

The fixation base 1 (such as the fixation base of left earphone or the fixation base of right earphone) is fixed on fixation scaffold 2 by several supporting columns 10, a standard microphone 3 is attached to the lower side of the fixation base 1, wherein the sensitivity and frequency response of the standard microphone 3 have been calibrated precisely, and the standard microphone 3 performs test by receiving the sound output from an earphone. By removing material inside the fixation base 1, a pass-through portion is formed passing through the fixation base (not illustrated in FIG. 1), and the sound communication between the earphone and the standard microphone is achieved by the pass-through portion.

A sealer is provided on the position on the upper side of the fixation base 1 in contact with the outer shell of the earphone. Preferably, the sealer is silicone rubber material, the sealer is integrally formed with the fixation base 1, and the sealer is provided with an earphone storage portion for placing the earphone. A sealer is provided on the position on the lower side of the fixation base 1 in contact with the standard microphone and integrally formed with the fixation base 1, and the sealer is a microphone attachment portion for attaching to the standard microphone 3.

The sealer is partially formed in the region of the pass-through portion in the fixation base 1, partially formed on the fixation base 1 (such as on the inner wall of the fixation base 1 in which material is removed, and on the outer surface of the fixation base 1), the earphone storage portion has a homologous shape as that of the earphone shell body placed in the earphone storage portion, and when the earphone is placed in the earphone storage portion, the sealer can come into contact with the outer shell of earphone tightly, carry on tight sealing effectively, and prevent sound leaking. Furthermore, the sealer can prevent damage to the outer shell of the earphone during testing, to ensure the outer shell of the earphone safe and intact.

The sealer being the earphone storage portion is partially formed on the area of pass-through portion in the fixation base 1, partially formed on the fixation base 1 (such as on the inner wall of the fixation base 1 in which material is removed, and on the outer surface of the fixation base 1), so that when the standard microphone 3 is attached to the microphone attachment portion, the sealer can come into contact with the outer shell of the standard microphone tightly, carry on tight sealing effectively, and prevent sound leaking. Furthermore, the sealer can prevent damage to the standard microphone 3 during testing, to ensure the outer shell of the standard microphone 3 safe.

The earphone testing device illustrated in the FIG. 1 further comprises a clip device 4, and the details of the structure of the clip device 4 will be mentioned correspondingly in the following description of the embodiment.

Figure 2:
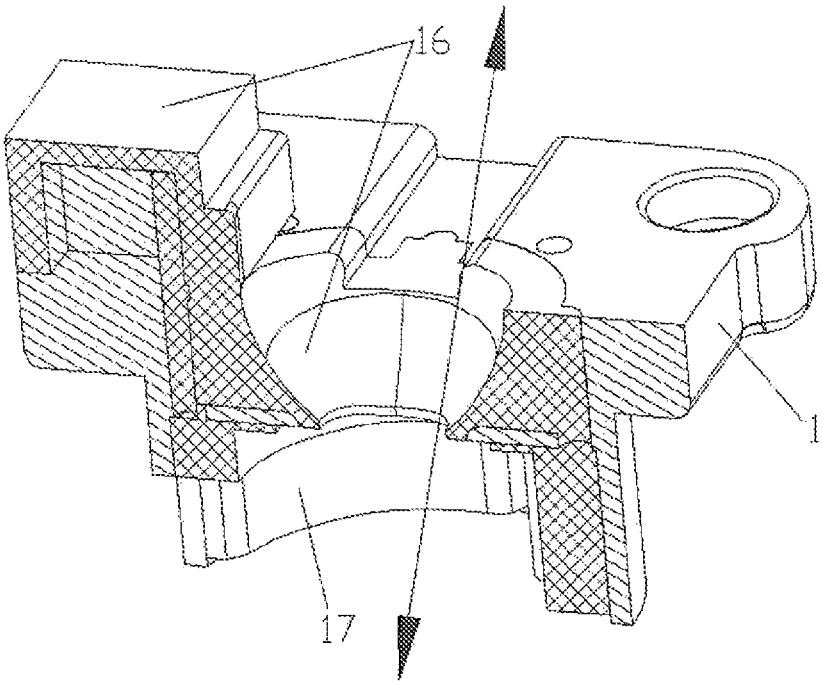
FIG. 2 is a longitudinal sectional view of a fixation base according to the embodiment of the present invention.

Furthermore, the structure of the fixation base 1 will be described with reference to FIG. 2 in the embodiment, and the other parts of the earphone testing device will be described in the other embodiments. FIG. 2 shows the longitudinal cross-sectional view of the fixation base 1, wherein, the pass-through portion of the fixation base 1 is a hollowed region in a top-bottom direction (indicated by an arrow symbol) in the middle part of the fixation base 1. The grid marked region in FIG. 2 is a cross-section of the sealer. It is seen from FIG. 2 that the sealer in the fixation base 1 in this embodiment is partially formed in the region of the pass-through portion in the fixation base 1, partially formed on the fixation base 1.

The upper part of the sealer in contact with the outer shell of the earphone forms the earphone storage portion 16, the lower part of the sealer in contact with the standard microphone forms the microphone attachment portion 17. The earphone storage portion 16 and the microphone attachment portion 17 in this embodiment are achieved by an integrally formed sealer.

Figure 3:
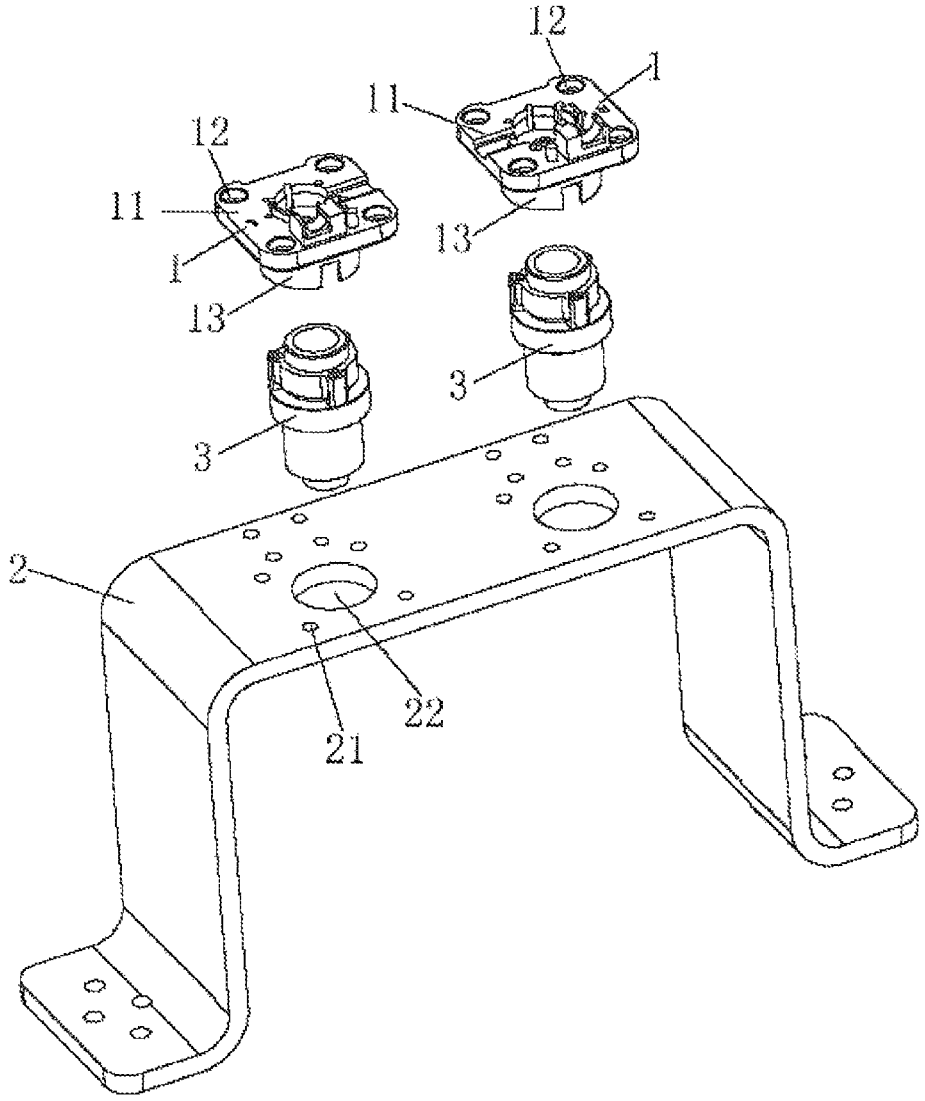
FIG. 3 is a schematic structural diagram of the fixation bases, standard microphones and a fixation scaffold in separated state according to the embodiment of the present invention.

The structure of the fixation base 1 will be described with reference to FIG. 3 in the embodiment, and the other parts of the earphone testing device will be described in the other embodiments. FIG. 3 is a schematic structural diagram of the fixation bases, the standard microphones and the fixation scaffold in separated state.

The hollowed region in the middle part of the fixation base 1 is a pass-through portion, the top part of the fixation base 1 has a plate-shaped flange 11 extending outwards from the fixation base, several mounting holes 12 are arranged on the plate-shaped flange 11, and mounting holes 21 are arranged on the positions on fixation scaffold 2 corresponding to the mounting holes 12.

In this embodiment, one end of each of the several supporting columns 10 with same length is fixed to the mounting hole 12 of the plate-shaped flange 11, and the other end is fixed to the mounting hole 21 of the fixation scaffold 2. As an example, the number of the supporting columns 10 may be 4. The supporting column 10 is in a hollow tubular structure, and when individual components are assembled together, bolts pass through the hollow supporting columns 10, the mounting holes 12 and the mounting holes 21, and then are fixed by nuts, thus fixation base 1 and the fixation scaffold 2 are combined fixedly. In this embodiment, by means of multiple hollow supporting columns 10 of same length, the fixation base 1 is attached onto the fixation scaffold 2 evenly and horizontally, the change of the chamber caused by height difference can be avoided, thus guarantee the precision and stability of testing result.

In this embodiment, a pass-through hole 22 is provided on the position on the fixation scaffold 2 mounting the fixation base 1, the standard microphone 3 passes through the fixation scaffold 2 from the pass-through hole 22, and is attached to the microphone attachment portion 13 on the fixation base 1. In this embodiment, the standard microphone 3 is attached to the fixation base through the scaffold, so the standard microphone 3 is only required to be screwed out to be calibrated during calibration, and the entire testing device is unnecessary to be detached, thus improving the flexibility of the structure of testing device, and facilitating the operation for testing.

The structure of the earphone testing device will be described with reference to FIGS. 4 and 5 in the embodiment, and the other parts of the earphone testing device will be described in the other embodiments. The testing device of this embodiment further comprises a clip device 4 (referring to FIG. 1), which fixes the earphone from the upper side of the earphone when the earphone is placed in the earphone storage portion 16, so that the left and right earphones are respectively retained in suitable, consistent positions in the fixation base of left earphone and the fixation base of right earphone, ensuring the consistency of testing result of left and right earphones. In addition, the clip device 4 makes earphone not mobile randomly during testing, further guarantees the precision and stability of testing.

Figure 4:
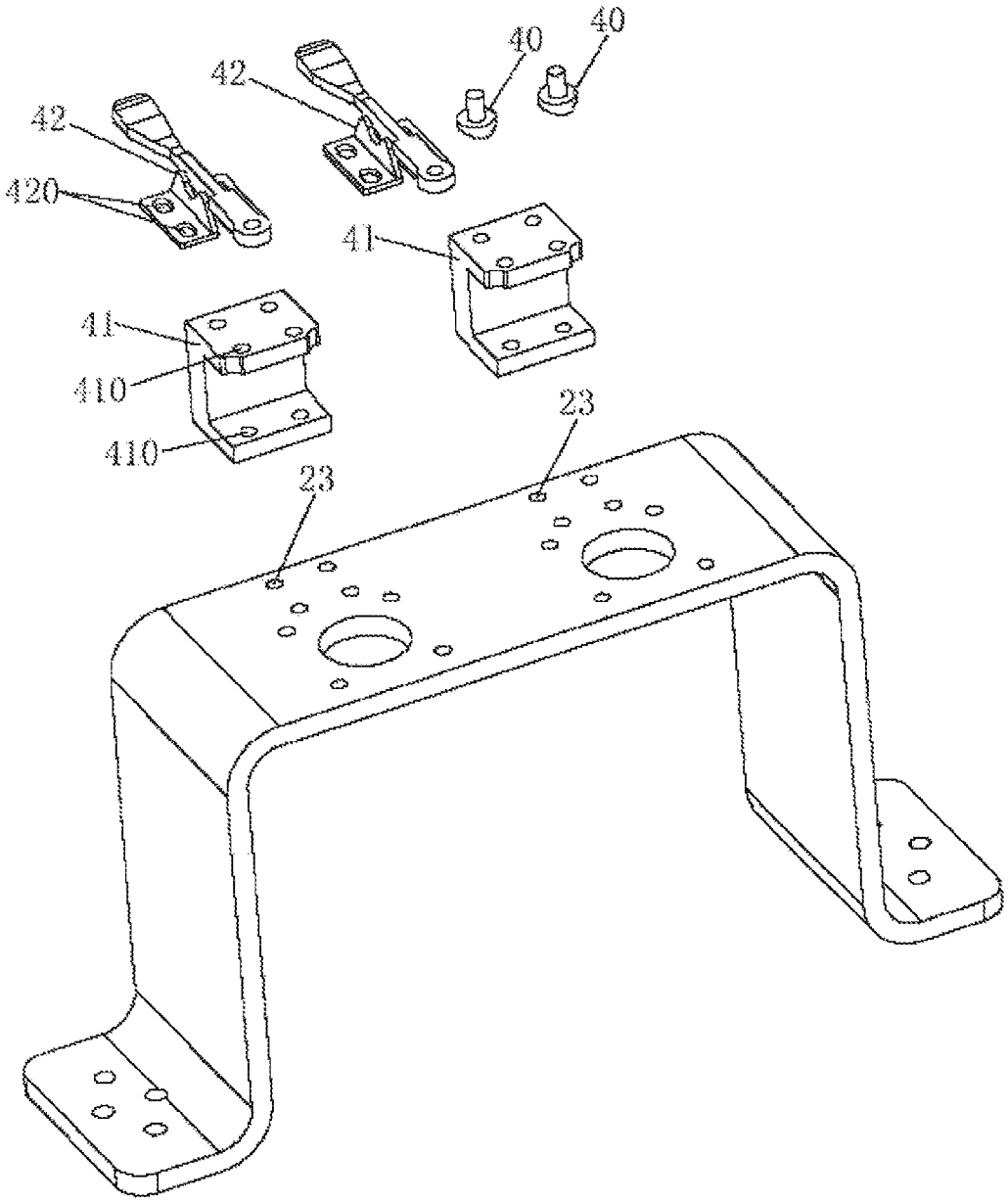
FIG. 4 is a schematic structural diagram of clip devices and the fixation scaffold in separated state according to the embodiment of the present invention.
Figure 5:
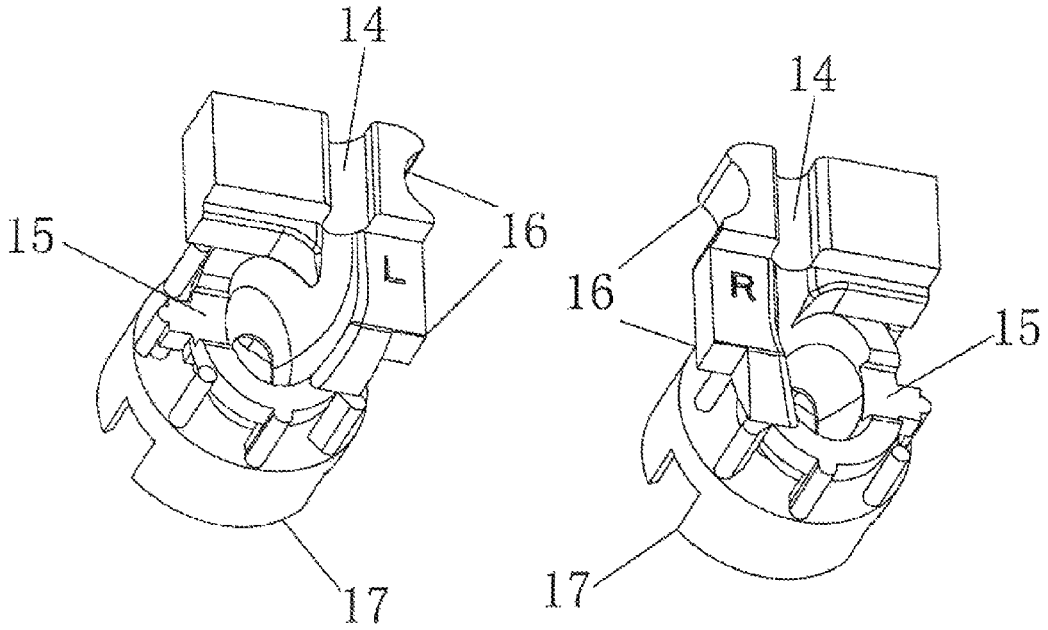
FIG. 5 shows a structure of sealers in the fixation bases according to the embodiment of the present invention.

Referring to FIG. 4, it shows the structural diagram of clip device 4 and fixation scaffold 2 in separated state. Clip device 4 is installed on the fixation scaffold 2, and the clip head 40 of clip device 4 corresponds to the position of the earphone storage portion. When the clip device 4 is clamped tightly, the clip head 40 of clip device 4 presses the earphone in the earphone storage portion tightly.

The clip device 4 comprises a clip body support 41 and a clip body 42 above the clip body support 41, one end of the clip body 42 is provided with a hole for installing the clip head 40, the clip head 40 in this embodiment is made of soft material, such as rubber or silicone, is able to make earphone after placed in the chamber is in contact with the chamber very tightly, prevent sound leaking, and improve the precision of testing.

The clip body support 41 is provided with mounting holes 410, the clip body 42 is provided with mounting holes 420, the fixation, scaffold 2 is provided with mounting holes 23 respectively in the position for mounting the clip device 4;

Several supporting columns 10 (referring to FIG. 1) fixe clip device 4 and fixation scaffold 2 together by passing through the mounting holes 410 of the clip body 42, the mounting holes 420 of the clip body support 41 and the mounting holes 23 of the fixation scaffold 2.

The fixation base in the embodiment of the present invention can be made, of material with a rather high hardness such as stainless steel etc., after the fixation base is formed, the material inside of the fixation base is removed (hollowed) to form a pass-through portion, then by use of mold and melted colloidal material, the sealer comprising an earphone storage portion and a microphone attachment portion is formed integrally. To facilitate manufacturing the sealer, in a manner, several channels can be provided in the fixation base for flowing channel and formation of melted colloidal material. Referring to FIG. 5, it shows the structure of integrated sealer of the earphone storage portion 16 and the microphone attachment portion 17 in the fixation base, in which, to make the structure of the sealer clearer, the structure of sealer is shown independently; however, with regards to an actual testing device, the sealer and the fixation base are integrated and inseparable. FIG. 5 shows the sealer in the fixation base of left earphone (with a L label) and the fixation base of right earphone (with a R label), these two sealers are symmetrical in structure, whose internal hollowed part (for communicating the earphone with the standard microphone) constructs the chamber for a testing earphone (the chamber is formed in the pass-through portion). The top end of earphone storage portion exemplified in FIG. 5 covers the corresponding position of the top part of fixation base.

A groove 14 is provided, on the earphone storage portion for placing an earphone handle, the groove 14 is benefit for fixing the location of earphone and making the earphone fit the earphone storage portion perfectly.

Furthermore, the fixation base in this embodiment is provided with a sound leaking trough 15, the position of the sound leaking trough 15 corresponds to the position of leaking hole on the earphone placed in the earphone storage portion. That is, the earphone has a leaking hole directing to the chamber, and after the earphone is placed in the earphone storage portion, the leaking hole of the earphone corresponds to the sound leaking trough 15. The sound leaking trough 15 not only makes earphone fit to the fixation base, but also prevents the occurrence of resonance phenomenon of chamber, which affects testing result. One manner of providing the sound leaking trough 15 is making the direction of sound leaking trough 15 vertical to the sound broadcasting direction in the chamber. The leaking hole 15 in FIG. 5 is an example, the leaking hole 15 is provided on top of the earphone storage portion (the fixation base).

Figure 6:
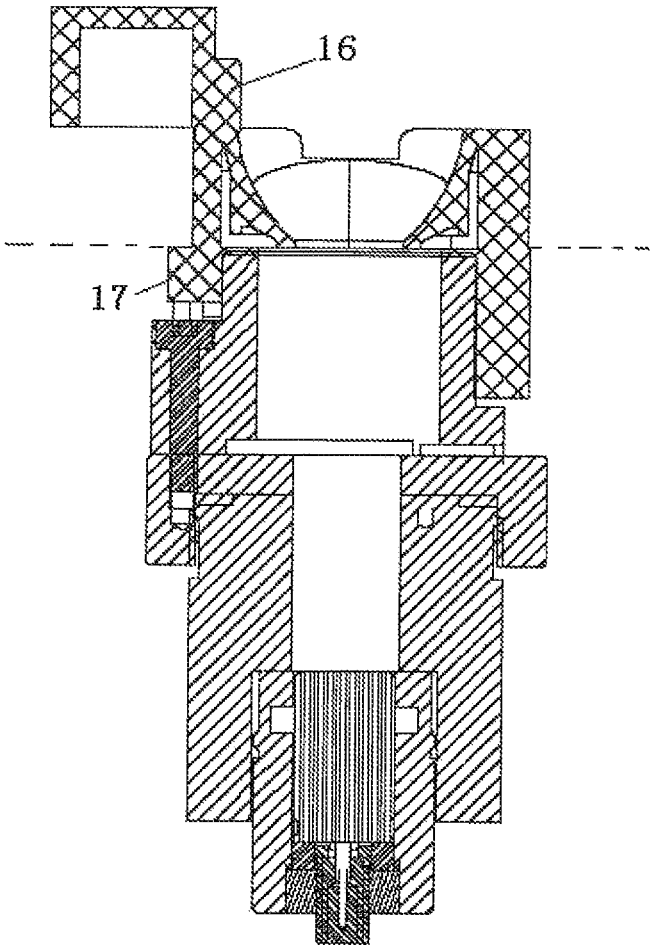
FIG. 6 is a schematic longitudinal cross-sectional structural diagram of the sealer and the standard microphone when the standard microphone and the fixation base are attached according to the embodiment of the present invention.

Referring to FIG. 6, it is a schematic diagram of longitudinal cross-section of the sealer and the standard microphone, which shows the schematic structure of longitudinal cross-section when the standard microphone and the fixation base are attached, and does not show the stainless steel part on the periphery of the fixation base, grid marked part in the upper part of cross view is the cross section part of the sealer in fixation base (comprising the earphone storage portion 16 and the microphone attachment portion 17). In the example shown in FIG. 6, the part of sealer above the dashed line in the figure can be deemed as the earphone storage portion 16, and the part of sealer below the dashed line in the figure can be deemed as the microphone attachment portion 17.

Figure 7:
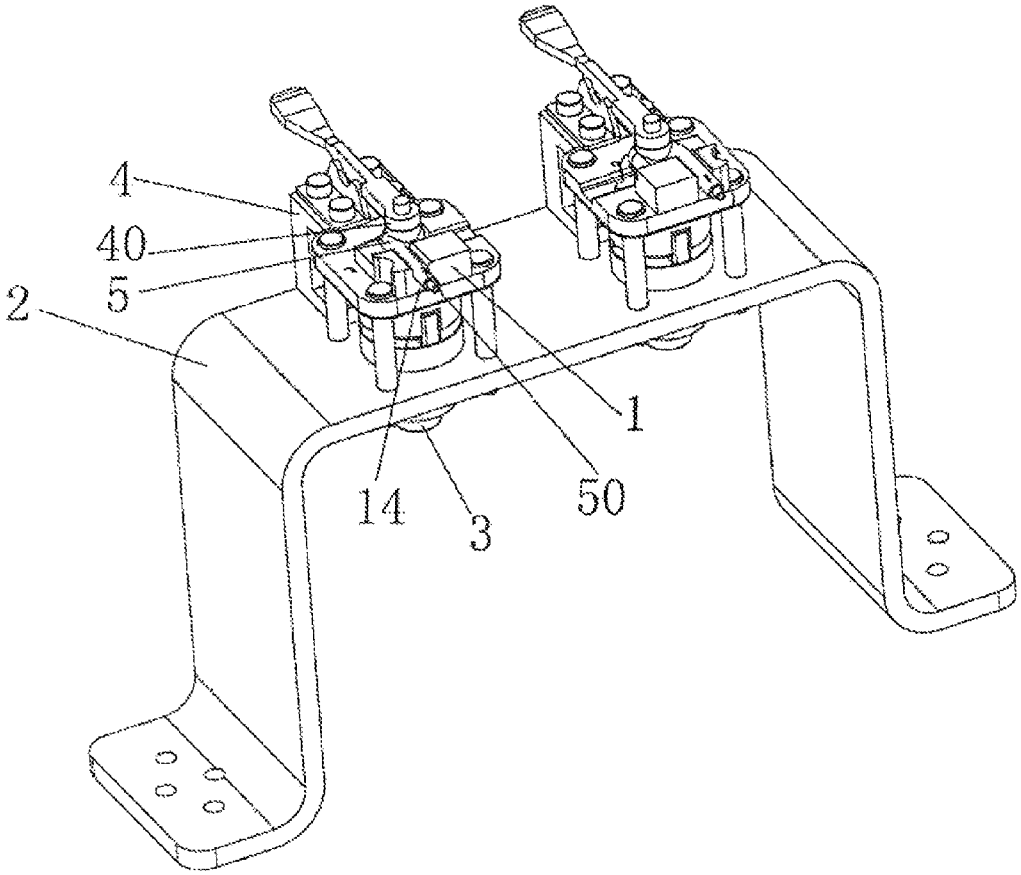
FIG. 7 is an entire structural diagram in which earphones are placed in the earphone testing device according to the embodiment of the present invention.

Referring to FIG. 7, it shows the entire structural figure of placing an earphone in the earphone testing device. It is seen from FIG. 7 that, the earphone 5 is placed in the earphone storage portion, the clip head 40 of the clip device 4 is clamped on the earphone 5, so that the earphone 5 is stabilized in an appropriate position in the earphone storage portion, and is in contact with the earphone storage portion tightly. The earphone handle 50 of earphone 5 is placed in the groove 14 on the earphone storage portion of fixation base 1 for placing the earphone handle. The standard microphone 3 passes through the hole on the fixation scaffold 2, and is attached to the microphone attachment portion in the fixation base 1. After the individual components are assembled as above, the testing of acoustic property of earphone can be started.

As proved by the test, when the left and right earphones are tested by the earphone testing device provided by the present solution (comprising the fixation base of left earphone and the fixation base of right earphone), the consistency of testing result of left and right earphones is maintained within 0.2 DB, a GRR (Gauge Repeatability and Reproducibility) below 10%.

Thus, it is seen that, the earphone testing device provided by the embodiments of the present invention, by use of the earphone storage portion in contact with the outer shell of an earphone and the microphone attachment portion in contact with the outer shell of a standard microphone formed by a sealer, is able to prevent sound leaking, guarantee the tightness of earphone testing device, thus improve the precision of testing result; furthermore, the present solution guarantees the stationarity of the fixation base by the supporting columns and the fixation scaffold, improves the stability of the testing result of earphone.

The aforesaid are merely preferable embodiments of the present invention, are not intended to restrict the protection scope of the present invention. Any modification, equivalent substitution, improvement etc., within the spirit and principle of the present invention, are included in the protection scope of the present invention.

The invention claimed is:

1. An earphone testing device, characterized in that the earphone testing device comprises a fixation base, a standard microphone attached to the fixation base, and a fixation scaffold for attaching and fixing the fixation base and the standard microphone;

the fixation base is supported and fixed on the fixation scaffold by several supporting columns;

a sealer is located on the position on the fixation base in contact with the outer shell of an earphone, the sealer forms an earphone storage portion for placing the earphone; and a groove is provided on the earphone storage portion for placing an earphone handle, a sound leaking trough is provided on the fixation base, the position of sound leaking trough corresponds to the position at leaking hole on the earphone placed in the earphone storage portion;

a sealer is located on the position on the fixation base in contact with the outer shell of the standard microphone, the sealer forms a microphone attachment portion for attaching to the standard microphone;

the earphone placed in the earphone storage portion and the standard microphone attached onto the microphone attachment portion are communicated with each other in the fixation base.

2. The earphone testing device according to claim 1, characterized in that a pass-through portion is provided in the fixation base and passes through the fixation base;

the earphone storage portion is located on the fixation base and in the pass-through portion, the microphone attachment portion is located on the fixation base and in the pass-through portion, the earphone placed in the earphone storage portion is communicated with the standard microphone attached onto the microphone attachment portion through the pass-through portion in the fixation base.

3. The earphone testing device according to claim 2, characterized in that the device further comprises a clip device, the clip device is installed on the fixation scaffold, a clip head of the clip device corresponds to the position of the earphone storage portion, and when the clip device is clamped tightly, the clip head of the clip device presses the earphone in the earphone storage portion tightly;

the clamp head is made of rubber or silicone.

4. The earphone testing device according to claim 3, characterized in that the clip device comprises a clip body support and a clip body above the clip body support, corresponding mounting holes are respectively provided on the positions for mounting the clip device on the clip body support, the clip body and the fixation scaffold;

several supporting columns pass through the mounting holes of the clip body, the clip body support and the fixation scaffold, fix the clip device and the fixation scaffold together.

5. The earphone testing device according to claim 1, characterized in that the fixation base fixed on the fixation scaffold through the supporting columns specifically comprising:

the top part of the fixation base has a plate-shaped flange extending outwards from the fixation base, several mounting holes are respectively provided on the corresponding positions of the plate-shaped flange and the fixation scaffold;

one end of each of the several supporting columns with same length is fixed to the mounting hole of the plate-shaped flange, and the other end is fixed to the mounting hole of the fixation scaffold.

6. The earphone testing device according to claim 1, characterized in that a pass-through hole is provided, on the position on the fixation scaffold for mounting the fixation base, the standard microphone passes through the fixation scaffold from the pass-through hole, and is attached to or detached from the microphone attachment portion on the fixation base.

7. The earphone testing device according to claim 1, characterized in that the fixation base is made of stainless steel, the sealer is made of silicone rubber.

8. The earphone testing device according to claim 7, characterized in that the fixation base comprises the fixation base of left earphone and the fixation base of tight earphone, and the fixation base of left earphone and the fixation base of right earphone are symmetrical in structure, each is supported and fixed on the fixation scaffold by the several supporting elements.

* * * * *